US005555941A

United States Patent [19]

Theurer et al.

[11] Patent Number: 5,555,941

[45] Date of Patent: Sep. 17, 1996

[54] MACHINE FOR WORKING WITH A SUCTION SNOUT ON THE BALLAST OF A TRACK BED

[75] Inventors: Josef Theurer, Vienna; Herbert Wörgötter, Gallneukirchen, both of Austria

[73] Assignee: Franz Plasser Bahnbaumashinen-Industriegesellschaft m.b.H., Vienna, Austria

[21] Appl. No.: 412,297

[22] Filed: Mar. 28, 1995

[30] Foreign Application Priority Data

Apr. 13, 1994 [AT] Austria ..... 763/94

[51] Int. Cl.[6] ..... E01B 27/00

[52] U.S. Cl. ..... 171/16; 37/104; 104/2

[58] Field of Search ..... 171/16; 37/104, 37/105; 104/2, 279, 280; 406/40, 67, 197; 285/63, 308, 276, 261, 319, 921

[56] References Cited

U.S. PATENT DOCUMENTS

| | | | |
|---|---|---|---|
| 1,329,554 | 2/1920 | Sims | 171/16 |
| 1,483,674 | 2/1924 | Owen | 171/16 |
| 1,576,093 | 2/1926 | Cooke | 171/16 |
| 3,876,260 | 4/1975 | Moss et al. | 302/36 |
| 4,071,148 | 1/1978 | Tibbs | 285/63 X |
| 4,147,156 | 9/1992 | Guettler et al. | 406/197 |
| 4,938,239 | 7/1990 | Theurer et al. . | |
| 5,003,662 | 4/1991 | Everts | 285/921 X |
| 5,120,165 | 6/1992 | Walko, Jr. | 406/40 |
| 5,150,991 | 9/1992 | Stoner et al. | 406/67 |
| 5,452,528 | 9/1995 | Theurer et al. | 171/16 X |
| 5,456,181 | 10/1995 | Theurer et al. | 171/16 X |

FOREIGN PATENT DOCUMENTS

| | | | |
|---|---|---|---|
| 312028 | 12/1973 | Austria . | |
| 2226612 | 1/1973 | Germany . | |
| 2136306 | 1/1973 | Germany . | |
| 8236650 | 6/1983 | Germany . | |
| 3318756 | 11/1984 | Germany . | |
| 573526 | 9/1977 | U.S.S.R. | 171/16 |
| 2172326 | 5/1988 | United Kingdom . | |
| 2270943 | 3/1994 | United Kingdom | 171/16 |
| 2273515 | 6/1994 | United Kingdom | 171/16 |
| 9417245 | 8/1994 | WIPO | 171/16 |

*Primary Examiner*—Terry Lee Melius
*Assistant Examiner*—Victor Batson
*Attorney, Agent, or Firm*—Collard & Roe, P. C.

[57] ABSTRACT

A machine for working on a ballast bed supporting a track comprises a machine frame, undercarriages supporting the machine frame on the track, and a ballast storage receptacle and a suction arrangement on the machine frame. The suction arrangement comprises a suction unit and a suction conduit connected to the suction unit, the suction conduit terminating in a vertically and transversely adjustable suction snout defining a suction opening for aspirating ballast into the ballast storage receptacle. A compressed air conduit connects a compressed air generating unit on the machine frame to the ballast storage receptacle for supplying compressed air thereto, and a blow conduit is connected to the ballast storage receptacle for blowing stored ballast out of the receptacle.

9 Claims, 1 Drawing Sheet

MACHINE FOR WORKING WITH A SUCTION SNOUT ON THE BALLAST OF A TRACK BED

BACKGROUND OF THE INVENTION

1. Field of the Invention

The present invention relates to a machine for working on a ballast bed supporting a track, which comprises a machine frame, undercarriages supporting the machine frame on the track, a ballast storage receptacle on the machine frame, and a suction arrangement on the machine frame, the suction arrangement comprising a suction unit and a suction conduit connected to the suction unit, the suction conduit terminating in a vertically and transversely adjustable suction snout defining a suction opening for aspirating ballast into the ballast storage receptacle.

2. Description of the Prior Art

One type of such a machine has been described in German utility model No. 8,236,650, published Jun. 30, 1983. This machine has a suction snout projecting from the machine frame and defining a suction opening for aspirating ballast from the track bed and a suction conduit for conveying the ballast to a ballast storage receptacle. After the aspirated ballast has been cleaned, the cleaned ballast is returned to the track bed by a transversely extending conveyor band.

Another type of such a machine is disclosed in German patent No. 2,136,306, wherein the suction snout projecting from the machine frame carries a suction nozzle with vibrators for loosening the ballast to be aspirated. An auxiliary port is arranged adjacent the suction opening and is connected to the input opening of a suction unit to enhance the aspirating capacity.

U.S. Pat. No. 4,938,239 discloses a mobile machine for cleaning the surface of a track bed by aspiration. A suction head extends over the entire width of the track bed and is connected to a suction unit. The suction head has a compressed air supply nozzle in the suction opening for causing turbulence in the surface dirt and this nozzle is connected to the output opening of the suction unit. Similar machines incorporating such a compressed air/suction system are disclosed in German patent No. 3,318,756 and Austrian patent No. 312,028.

SUMMARY OF THE INVENTION

It is a primary object of this invention to provide a machine of this type which enables the aspirated ballast to be removed from the ballast storage receptacle with very simple structural means.

This and other objects are accomplished according to the invention with a machine for working on a ballast bed supporting a track, which comprises a machine frame, undercarriages supporting the machine frame on the track, a ballast storage receptacle on the machine frame, and a suction arrangement on the machine frame, the suction arrangement comprising a suction unit and a suction conduit connected to the suction unit, the suction conduit terminating in a vertically and transversely adjustable suction snout defining a suction opening for aspirating ballast into the ballast storage receptacle. A compressed air conduit connects a compressed air generating unit on the machine frame to the ballast storage receptacle for supplying compressed air thereto, and a blow conduit is connected to the ballast storage receptacle for blowing stored ballast out of the receptacle and thus to remove the stored ballast therefrom.

This very simple structure enables the ballast storage receptacle to be rapidly emptied through the blow conduit without any retrofitting work. It also can serve rapidly to return limited amounts of the stored ballast to the track bed in case such ballast is locally needed at track points which have not enough ballast. In this respect, it is particularly advantageous that the blow conduit can supply desired amounts of ballast accurately to desired points of the track bed.

According to a preferred feature of the present invention, the compressed air generating unit comprises the suction unit and an output opening, the compressed air conduit being connected to the output opening of the suction unit. This makes particularly economical and rational use of existing units and capacities, thus further reducing construction costs.

If the machine further comprises remote-controllable valves in the conduits for selectively opening and closing respective ones of the conduits, its operation may be advantageously adapted to varying operating conditions either selectively to return the stored ballast to desired points of the track bed or to remove it to a storage car coupled to the machine frame.

Optimal and dependable removal of the stored ballast is assured if the ballast storage receptacle defines a receptacle chamber at a lower end of the receptacle, and the compressed air and blow conduits are connected to the receptacle chamber. A portion of the ballast storage receptacle adjoining an upper end of the receptacle chamber may be frusto-conically shaped, and if the ballast tends to stick together, it is advantageous to provide a ventilating conduit connected to the frusto-conically shaped ballast storage receptacle portion for conducting compressed air thereinto. This enables encrusted ballast pieces to be loosened and shaken apart in the simplest manner by the blown-in compressed air.

According to another preferred feature, the suction conduit has a port between the suction snout and the ballast storage receptacle, and the blow conduit is in communication with the suction conduit port. In this way, the suction snout may be selectively used for blowing ballast into the track bed, for which purpose an adjustment drive for properly locating the suction snout may be advantageously operated to aim the blown ballast at a desired location of the ballast bed.

The adaptability of the machine to various operating conditions is further enhanced if the machine frame has one end at which the suction snout is arranged, and the blow conduit extends in the longitudinal direction of the machine frame and has a closable snap coupling at an end of the blow conduit adjacent a machine frame end opposite to the one end. In this way, the blow conduit may be rapidly and simply connected with various types of ballast distribution devices or to a box car for transporting the ballast.

A very dependable switching between different ballast transport possibilities and selected ballast deposition at desired location of the ballast bed is obtainable if the blow conduit comprises a portion controlled by a flap valve, and a conduit connects the blow conduit portion to the suction conduit port, operation of the flap valve selectively directing the air stream in the blow conduit into the connecting conduit or through the blow conduit.

Finally, the machine may further comprise a humidifying unit connected to the blow conduit between the ballast storage receptacle and the blow conduit portion. This will effectively reduce the development of dust during the operation of the machine, thus improving the working conditions, and reduce environmental pollution.

BRIEF DESCRIPTION OF THE DRAWING

The above and other objects, advantages and features of the present invention will become more apparent from the following detailed description of a now preferred embodiment thereof, taken in conjunction with the accompanying somewhat schematic drawing wherein.

DETAILED DESCRIPTION OF PREFERRED EMBODIMENT

Figure 1:
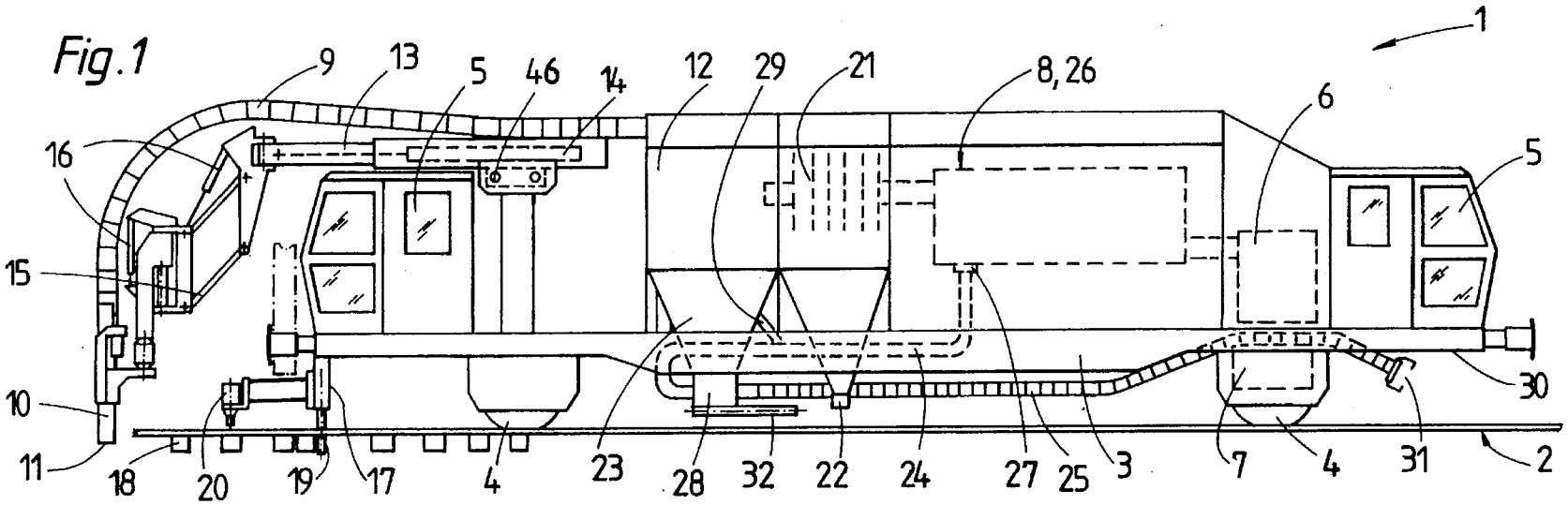
FIG. 1 is a side elevational view of a machine according to this invention.

Referring now to the drawing, FIG. 1 shows machine 1 for working on a ballast bed supporting track 2. The machine comprises machine frame 3 and undercarriages 4 supporting the machine frame on the track. Each end of machine frame 3 carries an operator's cab 5. A central power plant 6 serves to supply power to drive 7 for advancing machine 1 along track 2 and to all other operating drives of the machine.

Ballast storage receptacle 12 and a suction arrangement are mounted on machine frame 3, the suction arrangement comprising suction unit 8 and suction conduit 9 connected to the suction unit. The suction conduit terminates in vertically and transversely adjustable suction snout 10 defining suction opening 11 for aspirating ballast into ballast storage receptacle 12. Suction snout 10 is mounted on carrier frame 13 which, in turn, is cantilevered on machine frame 13 and projects from cab 5. The carrier frame is telescopingly arranged and may be extended by drive 14. It may also be transversely displaced with respect to the longitudinal direction of machine frame 3 along transverse guide 46. Parallelogram linkage 15 connects suction snout 10 with carrier frame 13 and drives 16 enable the snout to be vertically adjusted and pivoted in a transverse direction. When the machine is not operated, suction snout 10 may be moved into a rest position on machine frame 3 in front of cab 5, as shown in phantom lines.

The one end of machine frame 3 at which the suction snout is arranged also carries device 17 for displacing ties 18 of track 2, if such displacement is desired. Tie displacement device 17 is equipped with a vertically adjustable tie entrainment element 19 and a vertically and transversely adjustable spike or bolt remover and applicator 20 to enable fasteners, such as spikes or bolts, attaching the rails to the ties to be loosened and reattached.

Filter chamber 21 is arranged between ballast storage receptacle 12 and suction unit 8 for cleaning the suction air and to filter the dust therefrom. Accumulated dust settles in a frusto-conical bottom portion of filter chamber 21 whence it is periodically removed by screw conveyor 22.

Compressed air generating unit 26 on the machine frame is connected by compressed air conduit 24 to ballast storage receptacle 12 for supplying compressed air thereto, and blow conduit 25 is connected to the ballast storage receptacle for blowing stored ballast out of the receptacle. The compressed air generating unit comprises suction unit 8 and output opening 27, and compressed air conduit 24 is connected to output opening 27 of suction unit 8.

Ballast storage receptacle 12 defines cylindrical receptacle chamber 28 at a lower end of the receptacle, and the compressed air and blow conduits 24 and 25 are connected to receptacle chamber 28. A portion 23 of ballast storage receptacle 12 adjoining an upper end of receptacle chamber 28 is frusto-conically shaped, and aspirated ballast is collected in receptacle portion 23 whence it drops into cylindrical receptacle chamber 28 which is attached to frusto-conically shaped receptacle portion 23. Compressed air conduit 24 delivers compressed air to chamber 28 and blow line 25 removes the ballast from this chamber.

Ventilating conduit 29 is connected to frusto-conically shaped ballast storage receptacle portion 23 for conducting compressed air from compressed air conduit 24 thereinto to loosen the ballast collected in this receptacle portion.

The machine frame extends in a longitudinal direction and has one end at which suction snout 10 is arranged, and blow conduit 25 extends in the longitudinal direction from receptacle chamber 28 to an end of the blow conduit adjacent a machine frame end opposite to the one end, and the blow conduit end may be closed and carries a snap coupling 31 whereby the blow conduit may be readily connected to a mating coupling. Furthermore, a trap door or like emptying device 32 closes the bottom of receptacle chamber 28, and this device may be opened to enable receptacle 12 to be emptied, if desired.

Figure 2:
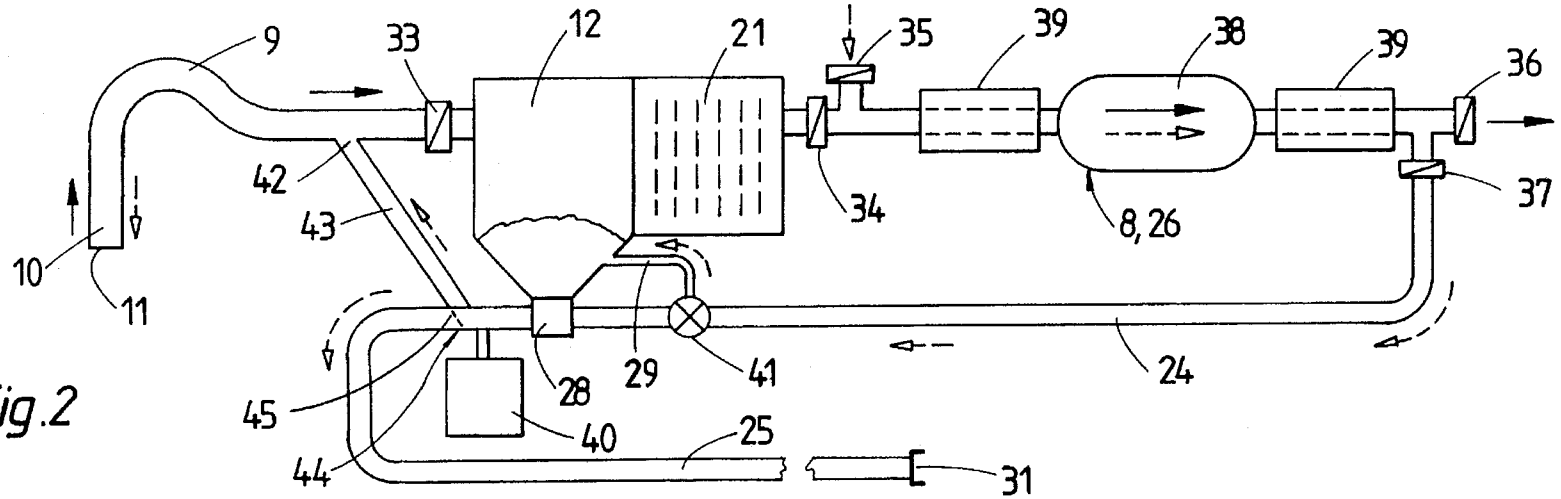
FIG. 2 is a diagram of the conduits for aspirating ballast into the ballast storage receptacle and for removing the stored ballast therefrom.

Further operating structures may be mounted on machine 1 but, since they have nothing to do with this invention, they have not been shown. The operation of the machine for aspirating ballast from the track bed and blowing the aspirated ballast out of storage receptacle 12 will now be further explained in connection with the operating diagram of FIG. 2.

As shown, remote-controllable valves 33 to 37 are mounted in conduits 9, 24 and 25 for selectively opening and closing respective ones of the conduits. The valves preferably are flap valves and may be operated from a control panel in cab 5. Suction unit 8 comprising compressed air generating unit consists of vacuum pump 38, and a sound damper 39 is arranged at the inputs and outputs of the vacuum pump. The direction of the aspirating air stream is shown by arrows in full lines while the direction of the air blast which removes the ballast from receptacle chamber 28 is shown by arrows in broken lines.

When ballast is to be aspirated through suction opening 11 in suction snout 10, valve 33 in suction conduit 9, valve 34 between filter chamber 21 and vacuum pump 38, and valve 36, through which the air cleaned in the filter chamber is removed, must be open. Valves 35 and 37 remain closed. In this operating stage, the ballast aspirated by vacuum pump 38 from the track bed is deposited in storage receptacle 12 and fills receptacle chamber 28.

When it is desired to remove ballast collected in storage receptacle 12 through receptacle chamber 28, valve 34 is closed and valve 35 is opened so that the vacuum pump is disconnected from filter chamber 21 and connected to a source of suction air. Valve 36 is closed and valve 37 is opened to permit the compressed air coming from the vacuum pump to flow into compressed air conduit 24 which leads the compressed air into receptacle chamber 28, and the compressed air causes the ballast in the chamber to be blown out through blow conduit 25.

To reduce the development of dust, which is unavoidable during the blowing of the ballast, humidifying unit 40 is connected to blow conduit 25 between ballast storage receptacle 12 and a blow conduit portion 44. The humidifying unit delivers water to the air-ballast mixture in the blow conduit to bind the dust in this mixture.

In case the ballast in storage receptacle 12 sticks together and forms clumps which do not readily slide into receptacle chamber 28, the compressed air in compressed air conduit 24 may be temporarily diverted from conduit 24 into ventilating conduit 29 by three-way valve 41 so that this air may loosen the ballast clumps.

The ballast removed through blow conduit 25 may be conveyed to a box car for transporting the ballast by connecting snap coupling 31 to the box car. However, there may be situations when it is desired to use suction snout 10 for returning stored ballast to the track bed, for example if there is not enough ballast in the track bed at some locations. For this purpose, suction conduit 9 has a port 42 between suction snout 10 and ballast storage receptacle 12, and blow conduit 25 is in communication with suction conduit port 42. The blow conduit comprises portion 44 controlled by flap valve 45, and conduit 43 connects blow conduit portion 44 to suction conduit port 42, operation of the flap valve selectively directing the air stream in the blow conduit into connecting conduit 43 or through blow conduit 45. When ballast is aspirated through suction conduit 9, connecting conduit 43 is closed by flap valve 45 to prevent any aspiration of compressed air from blow conduit 25. Humidifying unit 40 is preferably connected to blow conduit 25 between receptacle chamber 28 and blow conduit portion 44 so that the ballast returned to the track bed may also be wetted.

What is claimed is:

1. A machine for working on a ballast bed supporting a track, which comprises (a) a machine frame, (b) undercarriages supporting the machine frame on the track, (c) a ballast storage receptacle on the machine frame, (d) a suction arrangement on the machine frame, the suction arrangement comprising (1) a suction unit and (2) a suction conduit connected to the suction unit, the suction conduit terminating in a vertically and transversely adjustable suction snout defining a suction opening for aspirating ballast into the ballast storage receptacle, (e) a compressed air generating unit on the machine frame, (f) a compressed air conduit connecting the compressed air generating unit to the ballast storage receptacle for supplying compressed air thereto, and (g) a blow conduit connected to the ballast storage receptacle for blowing stored ballast out of the receptacle.

2. The machine of claim 1, further comprising remote-controllable valves in the conduits for selectively opening and closing respective ones of the conduits.

3. The machine of claim 1, wherein the ballast storage receptacle defines a receptacle chamber at a lower end of the receptacle, and the compressed air and blow conduits are connected to the receptacle chamber.

4. The machine of claim 3, wherein a portion of the ballast storage receptacle adjoining an upper end of the receptacle chamber is frusto-conically shaped.

5. A machine for working on a ballast bed supporting a track, which comprises (a) a machine frame, (b) undercarriages supporting the machine frame on the track, (c) a ballast storage receptacle on the machine frame, (d) a suction arrangement on the machine frame, the suction arrangement comprising (1) a suction unit and (2) a suction conduit connected to the suction unit, the suction conduit terminating in a vertically and transversely adjustable suction snout defining a suction opening for aspirating ballast into the ballast storage receptacle, the suction conduit having a port between the suction snout and the ballast storage receptacle, (f) a compressed air conduit connecting the compressed air generating unit to the ballast storage receptacle for supplying compressed air thereto, and (g) a blow conduit connected to the ballast storage receptacle for blowing stored ballast out of the receptacle, (1) the blow conduit being in communication with the suction conduit port.

6. The machine of claim 5, wherein the blow conduit comprises a portion controlled by a flap valve, further comprising a conduit connecting the blow conduit portion to the suction conduit port, operation of the flap valve selectively directing the air stream in the blow conduit into the connecting conduit or through the blow conduit.

7. The machine of claim 6, further comprising a humidifying unit connected to the blow conduit between the ballast storage receptacle and the blow conduit portion.

8. A machine for working on a ballast bed supporting a track, which comprises (a) a machine frame, (b) undercarriages supporting the machine frame on the track, (c) a ballast storage receptacle on the machine frame, (d) a suction arrangement on the machine frame, the suction arrangement comprising (1) a suction unit and (2) a suction conduit connected to the suction unit, the suction conduit terminating in a vertically and transversely adjustable suction snout defining a suction opening for aspirating ballast into the ballast storage receptacle, (e) a compressed air generating unit on the machine frame, (f) a compressed air conduit connecting the compressed air generating unit to the ballast storage receptacle for supplying compressed air thereto, the compressed air generating unit comprising (1) the suction unit and an output opening, (2) the compressed air conduit being connected to the output opening of the suction unit, and (g) a blow conduit connected to the ballast storage receptacle for blowing stored ballast out of the receptacle.

9. A machine for working on a ballast bed supporting a track, which comprises (a) a machine frame, (b) undercarriages supporting the machine frame on the track, (c) a ballast storage receptacle on the machine frame, the ballast storage receptacle defining (1) a receptacle chamber at a lower end of the receptacle, and (2) a portion of the ballast storage receptacle adjoining an upper end of the receptacle chamber being frusto-conically-shaped, (d) a suction arrangement on the machine frame, the suction arrangement comprising (1) a suction unit and (2) a suction conduit connected to the suction unit, the suction conduit terminating in a vertically and transversely adjustable suction snout defining a suction opening for aspirating ballast into the ballast storage receptacle, (e) a compressed air generating unit on the machine frame, (f) a compressed air conduit connecting the compressed air generating unit to the ballast storage receptacle for supplying compressed air thereto, (g) a blow conduit connected to the ballast storage receptacle for blowing stored ballast out of the receptacle, (1) the compressed air and blow conduits being connected to the receptacle chamber, and (h) a ventilating conduit connected to the frusto-conically shaped ballast storage receptacle portion for conducting compressed air thereinto.

* * * * *